US005603166A

United States Patent [19]

Shimazaki et al.

[11] Patent Number: 5,603,166

[45] Date of Patent: Feb. 18, 1997

[54] EXTRACTOR FOR REMOVING WATER FROM WASHED ARTICLES

[75] Inventors: Masaru Shimazaki; Fumikata Maeda, both of Tokyo, Japan

[73] Assignee: Y.A.C. Corporation, Tokyo, Japan

[21] Appl. No.: 637,332

[22] Filed: Apr. 23, 1996

Related U.S. Application Data

[63] Continuation of Ser. No. 340,978, Nov. 17, 1994, abandoned.

[30] Foreign Application Priority Data

Nov. 25, 1993 [JP] Japan ..... 5-319051

[51] Int. Cl.[6] ..... F26B 17/24

[52] U.S. Cl. ..... 34/58; 34/186; 34/314

[58] Field of Search ..... 34/58, 314, 315, 34/186, 187

[56] References Cited

U.S. PATENT DOCUMENTS

| | | | |
|---|---|---|---|
| 2,887,864 | 5/1959 | Tegerdine | 34/58 |
| 4,200,992 | 5/1980 | Zumpano . | |
| 4,693,017 | 9/1987 | Oehler et al. | 34/58 |
| 4,852,270 | 8/1989 | Dettin | 34/58 |
| 4,897,933 | 2/1990 | Ito et al. | 34/58 |
| 5,339,539 | 8/1994 | Shiraishi et al. | 34/58 |

*Primary Examiner*—John T. Kwon

*Attorney, Agent, or Firm*—Majestic, Parsons, Siebert & Hsue

[57] ABSTRACT

An extractor for removing water from washed articles hung from hangers includes a hollow outer structure 11 containing therein a hollow inner structure 12 having side walls made of a perforated sheet metal and a motor 31 for rotating the inner structure 12. Both structures 11 and 12 are open at the top, and a plurality of hanger-supporting pieces 16 are attached to the inner structure 12 for suspending therefrom hangers 1 carrying washed articles. There are also a supply device 50A for causing hangers 1 to become suspended from the hanger-supporting pieces 16 from above and a discharge device 50B for removing hangers carrying dehydrated articles thereon from the hanger-supporting pieces 16 upward to above the inner structure 12.

11 Claims, 5 Drawing Sheets

EXTRACTOR FOR REMOVING WATER FROM WASHED ARTICLES

This is a continuation of application Ser. No. 08/340,978 filed Nov. 17, 1994, now abandoned.

BACKGROUND OF THE INVENTION

This invention relates to a so-called extractor for removing water from articles washed by an industrial washing machine.

It is well known to use an extractor to remove (or extract) water from articles which have undergone a main washing process with a solvent, a cleanser or water in an industrial washing machine and then to dry them inside a drier. In the main washing process, many articles are usually washed together inside a washing machine which is also used for extracting water from the washed articles. Since clothing articles thus washed cannot usually keep their shapes well, the applicant herein has earlier proposed a washing process whereby clothing articles to be washed are hung from individual hangers, which are then suspended from a conveyor means, a means for the main washing process being provided on the travel path of the conveyor means. With such a process, clothing articles which are individually hung from hangers can now be subjected to a main washing process, but no adequate means has yet been developed for extracting water from clothing articles washed by such a process, and this has been a bottleneck in the development of a smooth-operating line of washing processes.

SUMMARY OF THE INVENTION

It is therefore an object of this invention to provide an extractor which is capable of extracting water from washed articles while they are hung from hangers such that a smooth-operating line of washing processes can be established.

It is another object of this invention to provide such an extractor capable of allowing articles to be quickly delivered into it and discharged out of it.

An extractor according to the present invention, with which the above and other objects can be accomplished, may be characterized not only as comprising a hollow outer structure with open top, a hollow inner structure inside the outer structure, and driving means for rotating the inner structure but also wherein the inner structure has open top and side walls made of a perforated sheet metal, and the extractor further comprises a plurality of hanger-supporting pieces inside and on the side walls of the inner structure for suspending therefrom hangers for carrying washed articles thereon, supply means for causing hangers carrying washed articles thereon to become suspended from the hanger-supporting pieces from above, and discharge means for removing hangers carrying water-extracted articles thereon from the hanger-supporting pieces upward to above the inner structure.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

Figure 1:
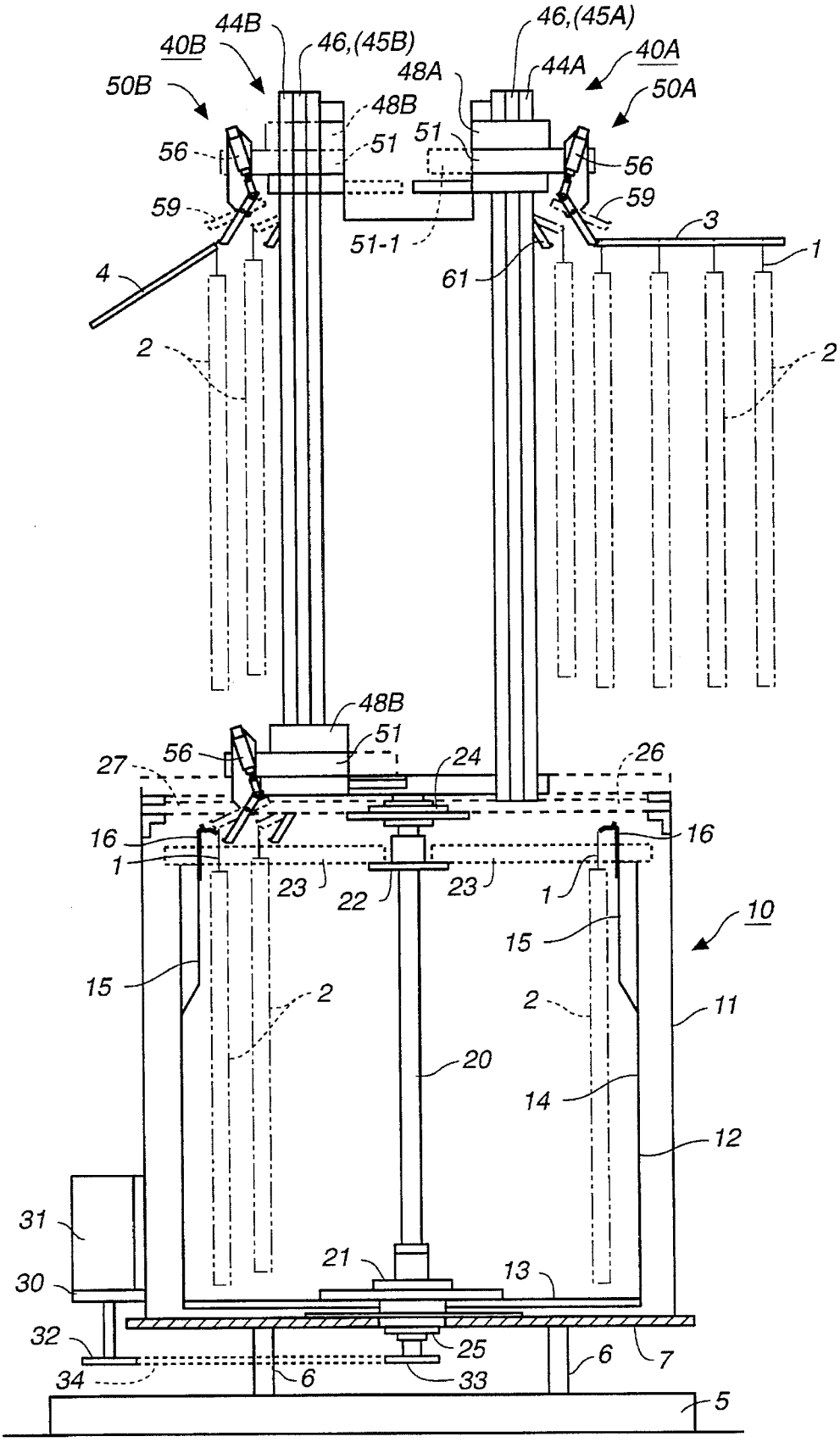
FIG. 1 is a partially sectional front view of an extractor embodying the invention.
Figure 2:
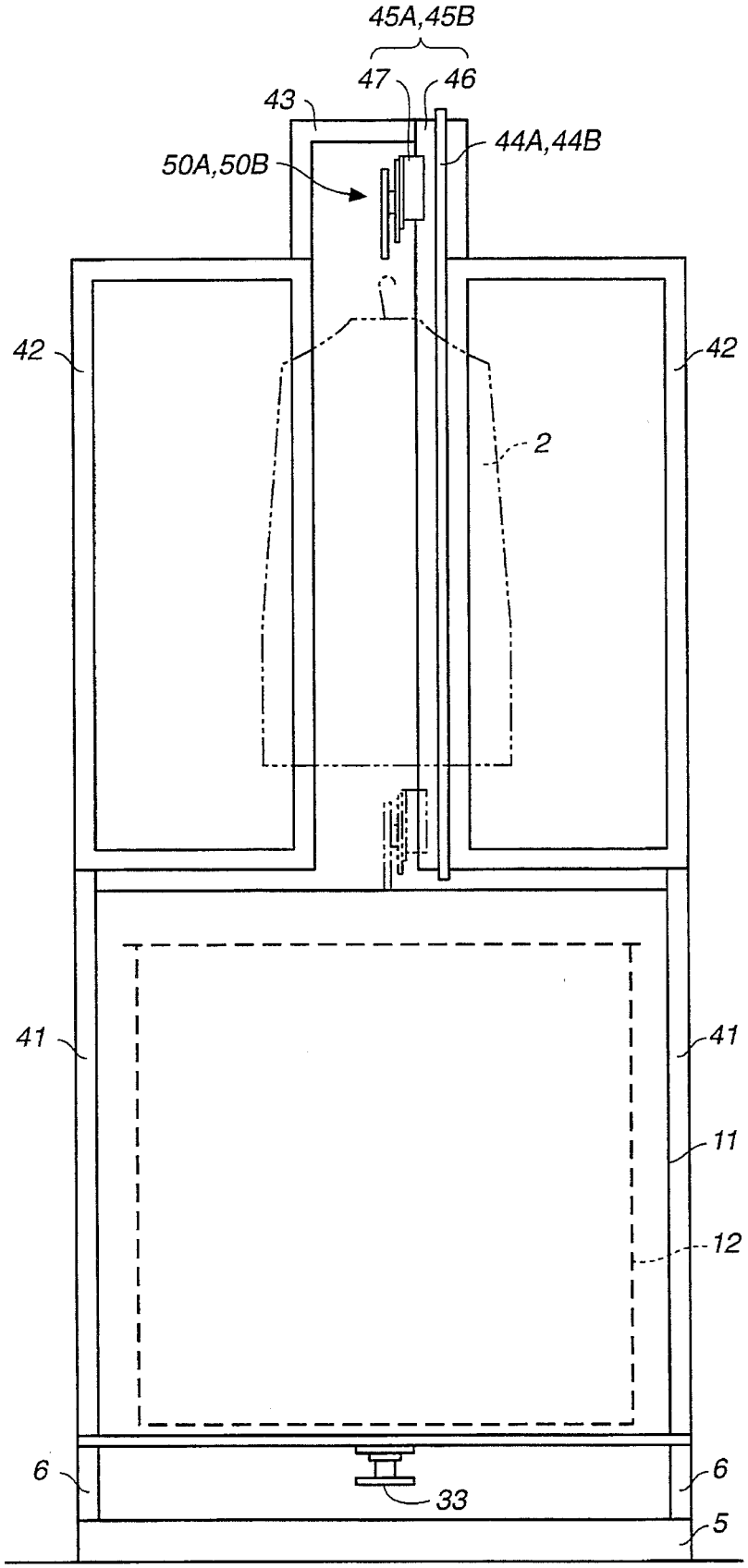
FIG. 2 is a side view of the extractor of FIG. 1.
Figure 3:
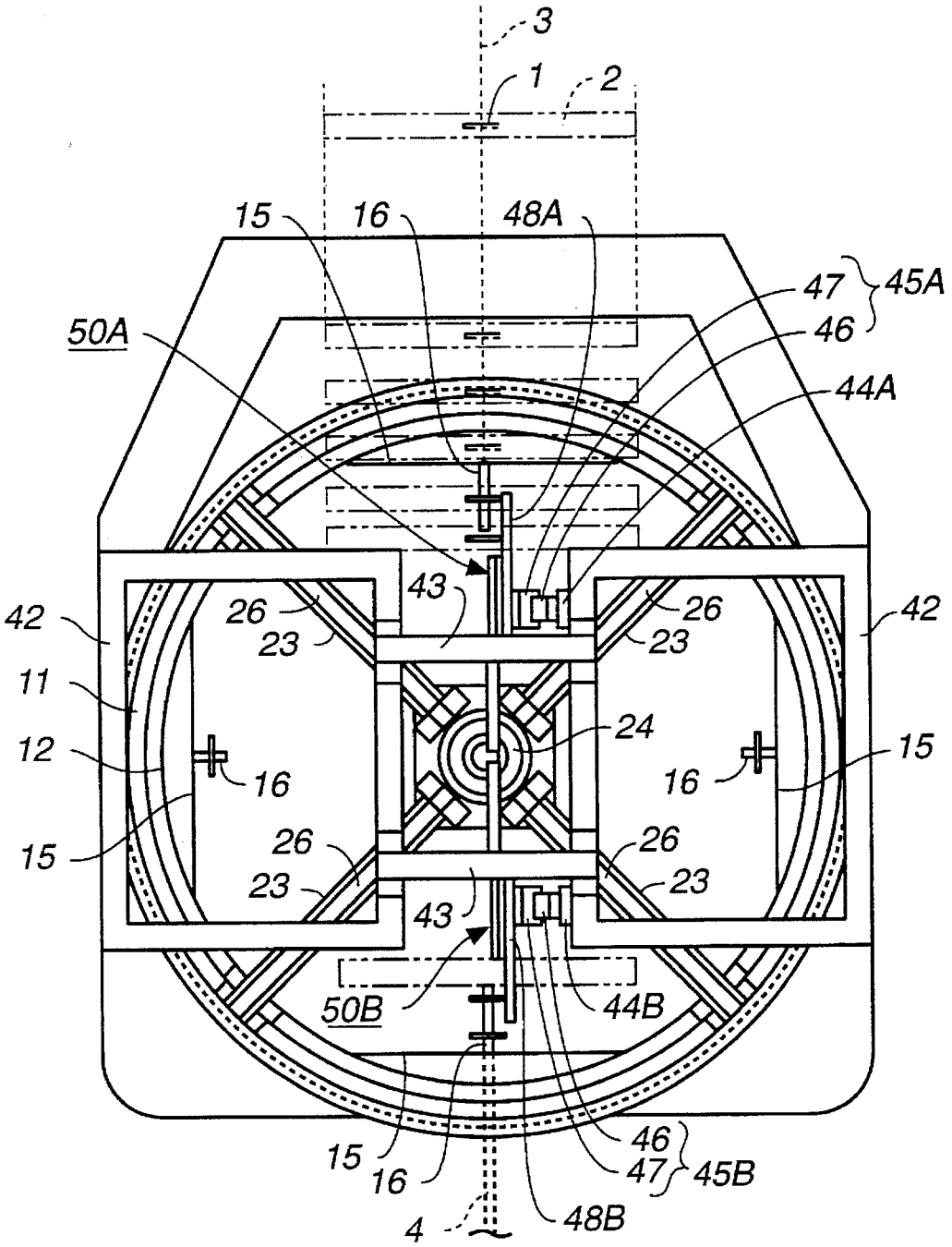
FIG. 3 is a plan view of the extractor of FIG. 2.
Figure 4:
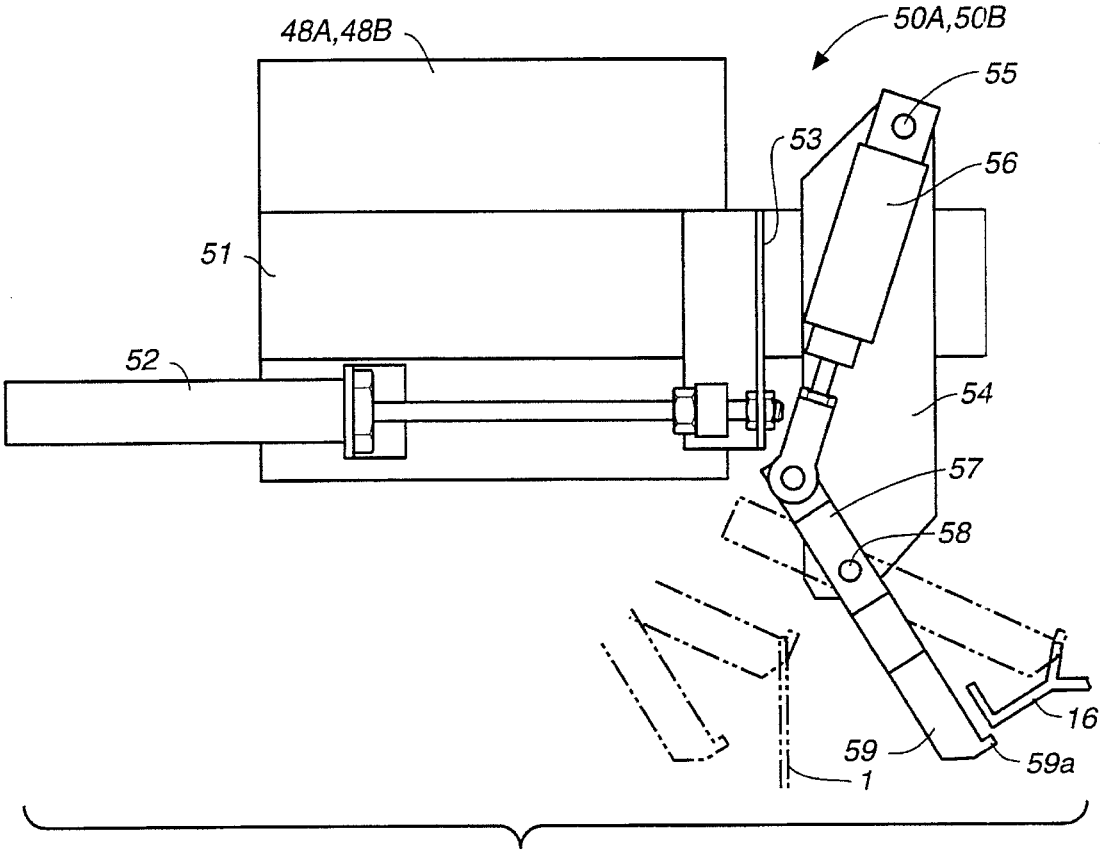
FIG. 4 is a front view of the article-transferring means.
Figure 5:
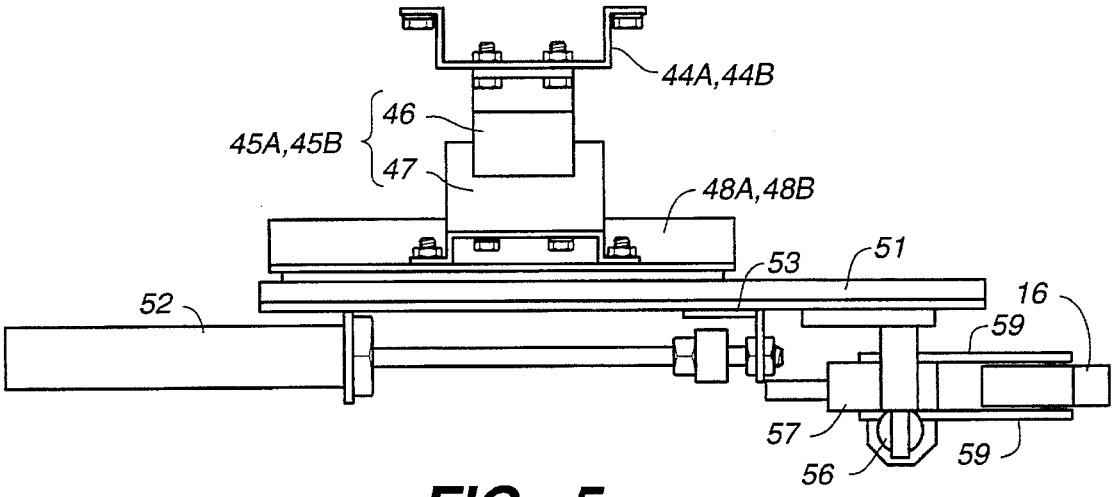
FIG. 5 is a plan view of the article-transferring means of FIG. 4.

In what follows, an extractor according to the present invention is described with reference to FIGS. 1–6. As shown in FIGS. 1–3, the extractor comprises an extraction section 10, a supply means 40A for supplying washed articles 2 hung individually from hangers 1 into the extraction section 10, and a discharge means 40B for taking water-extracted articles 2 out of the extraction section 10. The hangers 1, from which the washed articles 2 are hung, are suspended from a conveyor means 3, by which they are transported to this extractor. Numeral 4 indicates a discharge chute to which the water-extracted articles 2 are transported from the extractor. Numeral 5 indicates a base for the extractor, and a support plate 7 is attached to this base 5 by way of support columns 6.

The extraction section 10 is of a double structure with an outer structure 11 using the support plate 7 as its bottom plate and an inner structure 12 which is rotatably disposed inside the outer structure 11. The inner structure 12 is formed with a bottom plate 13 and cylindrically shaped side plates 14 made of a perforated sheet metal, and is open at the top. Four upwardly extending hanger-supporting plates 15 are attached to the inner walls of the side plates 14, and a hanger-supporting piece 16 with a V-shaped end is affixed to each of these hanger-supporting plates 15.

A vertical rotary shaft 20 is at the center of the inner structure 12, penetrating the bottom plate 13 and the support plate 7. The bottom end of this rotary shaft 20 is attached to the bottom plate 13 by way of an affixing member 21. Another affixing member 22 is attached to the upper end of the rotary shaft 20, four reinforcing plates 23 being attached to both this affixing member 22 and the top end of the side plates 14. The top and bottom ends of the rotary shaft 20 are rotatably supported by bearings 24 and 25. The upper bearing 24 is fastened to the top end of the outer structure 11 by means of a bearing-supporting plate 26, and the lower bearing 25 is fastened to the aforementioned support plate 7.

A motor 31 is fastened to the outer structure 11 by means of a motor-supporting plate 30, and a pulley 32 is affixed to the drive shaft of the motor 31. Another pulley 33 is affixed to the bottom end of the aforementioned rotary shaft 20, an endless timing belt 34 being stretched between these two pulleys 32 and 33.

Next, the structure of the supply means 40A and the discharge means 40B will be described. Since these means 40A and 40B are identically structured, mutually corresponding components will be indicated by the same numeral, but followed by letter "A" or "B" whenever distinction is necessary, depending upon whether the indicated component is a part of the supply means 40A or the discharge means 40B.

As shown in FIG. 2, a pair of vertical plates 41 is affixed to the support plate 7 outside the outer structure 11 and mutually opposite to each other, and a pair of vertical frame plates 42 is fastened to the vertical plates 41 thereabove, two connecting plates 43 connecting the top ends of the frame plates 42. Two vertically extending slider-supporting plates 44A and 44B are affixed to the inner surface of one of the two frame plates 42. Vertically extending stationary parts 46 of rodless cylinders 45A and 45B are affixed respectively to the slider-supporting plates 44A and 44B. Vertically movable sliders 48A and 48B are affixed to mobile parts 47 of the rodless cylinders 45A and 45B, respectively.

Article delivering means 50A and 50B, structured in plane symmetrical relationship with respect to each other, are attached respectively to these sliders 48A and 48B. As shown more clearly in FIGS. 4 and 5, a horizontally slidable plate 51 is attached to each of the sliders 48A and 48B. A horizontally operating air cylinder 52 is also affixed to each of the sliders 48A and 48B parallel to the direction in which the plate 51 is adapted to slide, and the actuating rod of the air cylinder 52 is fastened to the plate 51 by means of an actuation plate 53. A support plate 54 is attached to the horizontally slidable plate 51, and a hook-operating air cylinder 56 is supported by a support shaft 55 affixed to the support plate 54 so as to be able to oscillate around this support shaft 55. A hook-supporting plate 57 is rotatably connected to the actuating rod of the hook-operating air cylinder 56, and is itself rotatably supported by the support plate 54 around a support shaft 58. Hooks 59 each with a hooking tip **59*a* are affixed to both side surfaces of the hook-supporting plate 57**.

Figures 6A, 6B:
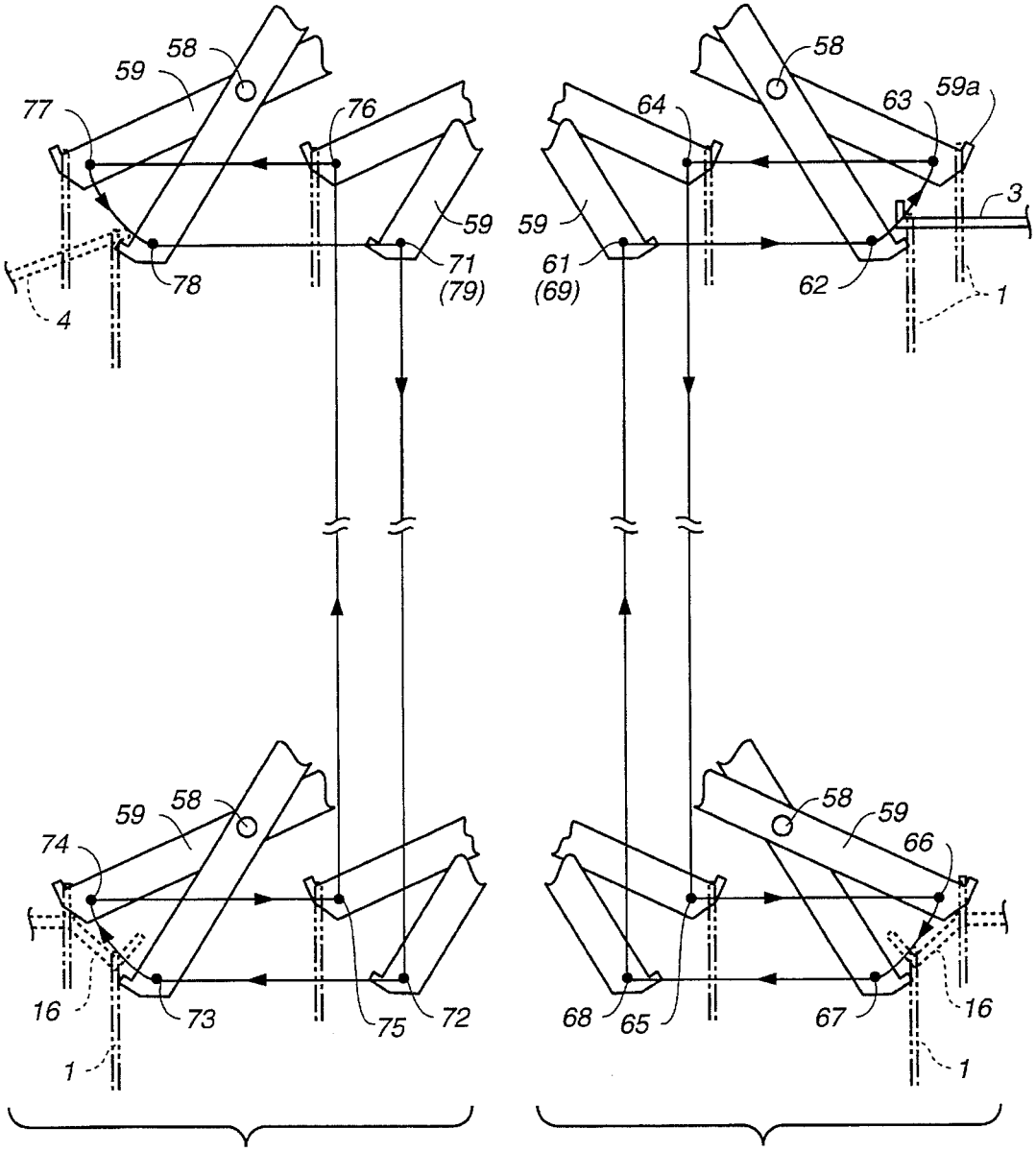
FIGS. 6A and 6B are schematic front views for showing the operations of supplying and removing a washed article into and out of the extractor of FIGS. 1 and 2.

Next will be described the mode of operating the extractor structured as explained above. FIG. 6A shows the step of delivering washed articles 2 hung from hangers 1 to the extraction section 10. This operation is accomplished by activating the rodless cylinder 45A and the article delivering means 50A of the supply means 40A. The slider 48A of the supply means 40A is at the raised position shown by solid lines in FIG. 1, the air cylinders 52 and 56 of the article delivering means 50A are in retracted condition, and the horizontally slidable plate 51 and the hook 59 are at positions shown respectively at 51-1 (in FIG. 1) and 61. The horizontally operating air cylinder 52 is then activated to advance the slidable plate 51 towards the conveyor means 3 to the position shown by solid lines, causing the hook 59 to reach a position 62 below the hanger 1 suspended from the conveyor means 3. Next, the hook-operating air cylinder 56 is activated so as to rotate the hook 59 around its support shaft 58 and to move its tip **59*a* to a raised position 63, thereby picking up the hanger I from the conveyor means 3. Now that the washed article 2 is thus hanging from the hook 59, the horizontally operating air cylinder 52 is activated to move backward and the hook 59 is brought to a raised but retracted position 64. Next, the rodless cylinder 45A is activated to move the slider 48A downward to bring the hook 57 to a raised retracted position 65 inside and a little higher than the hanger-supporting piece 16 of the extraction section 10. The horizontally operating air cylinder 52 is activated next to advance the slider 48A towards the hanger-supporting piece 16 to an advanced position 66 thereabove and the hook-operating air cylinder 56 is activated thereafter in the opposite direction so as to rotate the hook 59 around its support shaft 58 to a lowered position 67, thereby causing the hanger 1 to become suspended from the hanger-supporting piece 16. In other words, the washed article 2 from which water is to be extracted is still hanging from the hanger 1 and is now suspended inside the extraction section 10. The horizontally operating air cylinder 52 is then activated in the opposite direction to retract the slider 48A so as to move back the hook 59 to a retracted position 68. Finally, the rodless cylinder 45A is activated in the opposite direction to raise the slider 48A upward to the original position 61 (=69), thereby completing one cycle of the step for transferring a washed article hung from a hanger into the extraction section 10 and to suspend it from the hanger-supporting piece 16. In summary, the hook 59 is moved from 61 to 64 for receiving a washed article from the conveyor means 3 and from 65 to 68 for suspending it inside the extraction section 10. The motor 31 is thereafter activated to rotate the rotary shaft 20, and hence the inner structure 12, by 90 degrees to move another one of the hanger-supporting pieces 16 to the article-receiving position shown in FIG. 6A. The cycle described above is then repeated. Since there are four hanger-supporting pieces 16 provided to the inner structure 12 according to the embodiment described herein, the aforementioned cycle is repeated four times to completely load the extraction section 10**.

After washed articles 2 are suspended from all of the hanger-supporting pieces 16, the motor 31 is activated for a specified period of time to cause the inner structure 12 to rotate therewith, thereby removing water from the washed articles 2 suspended therein by the centrifugal force acting thereon. The removed water is passed through the openings through the inner structure 12 to fly towards the outer structure 11 and to fall down and be discharged through a discharge opening (not shown). When the motor 31 is deactivated after the specified period of time, the inner structure 12 is stopped such that one of the hanger-supporting pieces 16 is at an article-discharging position from which one of water-extracted articles can be removed, as will be explained below.

Next, the water-extracted articles are removed from the extraction section 10 to the discharge means 40B by activating the rodless cylinder 45B and the article delivering means 50B. As shown in FIG. 6B, the hook 59 in the article delivering means 50B at its initial position 71 is moved to a lowered position 72 below the hanger-supporting piece 16 by the operation of the rodless cylinder 45B to move the slider 48B downward. The operation for moving the hook 59 thereafter through positions indicated sequentially by 73, 74 and 75 to receive the water-extracted article 2 is exactly opposite to the operation described above for moving the hook 59 of FIG. 6A through the positions 65, 66, 67 and 68, and hence its detailed description will be omitted.

Next, the rodless cylinder 45B is activated in the opposite direction to move the slider 48B upward to bring the hook 59 to a raised position 76 in front and above the discharge chute 4. The subsequent operation for moving the hook 59 through positions indicated sequentially 77, 78 and 79 (=71) to discharge the hanger 1 to the discharge chute 4 is exactly opposite to the operation described above for moving the hook 59 of FIG. 6A through the positions 61, 62, 63 and 64, and hence its detailed description will be again omitted. The hanger 1 with the water-extracted article 2 discharged to the discharge chute 4 is caused to slide therealong down to the next process.

Next, the motor 31 is activated as described above to rotate the inner structure 12 by 90 degrees until the hanger 1 suspended from the next hanger-supporting piece 16 reaches the article-transferring position shown in FIG. 6B. The cycle described above is then repeated such that all water-extracted articles inside the inner structure 12 are removed from the extraction section 10 to the discharge chute 4.

The extraction process is completed by carrying out the series of steps described above. The next cycle of steps for suspending washed articles from the hanger-supporting pieces 16 is commenced thereafter.

In summary, the present invention makes it possible to carry out extraction while the washed articles are still hanging from their hangers such that the series of washing processes can be carried out smoothly along a line. Since the articles from which water is to be removed are transported into the inner structure 12 from above by the supply means 40A and removed from the inner structure upwards by the discharge means 40B, the washed articles can be moved in and out quickly.

What is claimed is:

1. An extractor for washed articles, comprising;

a hollow outer structure with open top;

a hollow inner structure inside said outer structure, said inner structure having open top and perforated side walls;

driving means for rotating said inner structure;

a plurality of supporting means inside and on said side walls of said inner structure for supporting washed articles;

supply means for delivering washed articles thereon downward into said hollow inner structure and causing said washed articles to become supported by said supporting means; and discharge means for removing said washed articles upwards from said supporting means and out of said inner structure;

wherein said washed articles are each hung from a hanger, said plurality of supporting means are each capable of allowing an article-carrying hanger to hang therefrom, said supply means is capable of delivering an article-carrying hanger downward into said hollow inner structure and causing said hanger to become supported by said supporting means, and said discharge means is capable of removing an article-carrying hanger upwards from said supporting means and out of said inner structure.

2. An extractor for washed articles, comprising;

a hollow outer structure with open top;

a hollow inner structure inside said outer structure, said inner structure having open top and perforated side walls;

driving means for rotating said inner structure;

plurality of supporting means inside and on said side walls of said inner structure for supporting washed articles;

supply means for delivering washed articles thereon downward into said hollow inner structure and causing said washed articles to become supported by said supporting means; and discharge means for removing said washed articles upwards from said supporting means and out of said inner structure;

wherein said supply means and said discharge means each comprise a slider adapted to move vertically upward and downward and article delivering means attached to said slider for delivering washed articles, said article delivering means comprising:

a slidable plate which is slidable horizontally with respect to said slider;

a hook which is rotatably supported by said slidable plate;

slider-driving means for moving said slider vertically upward and downward;

horizontally driving means for causing said slidable plate to slide horizontally with respect to said slider; and hook-driving means for causing said hook to swing with respect to said slidable plate.

3. The extractor of claim 1 wherein said supply means and said discharge means each comprise a slider adapted to move vertically upward and downward and article delivering means attached to said slider for delivering an article-carrying hanger, said article delivering means comprising:

a slidable plate which is slidable horizontally with respect to said slider;

a hook which is rotatably supported by said slidable plate;

slider-driving means for moving said slider vertically upward and downward;

horizontally driving means for causing said slidable plate to slide horizontally with respect to said slider; and hook-driving means for causing said hook to swing with respect to said slidable plate.

4. The extractor of claim 3 wherein said hook has a hanger-supporting end for suspending an article-carrying hanger therefrom, and wherein said slider-driving means, said horizontally driving means and said hook-driving means cooperate to transfer an article-carrying hanger selectively from said hanger-supporting end of said hook to one of said plurality of supporting means or from one of said plurality of supporting means to said hanger-supporting end of said hook.

5. The extractor of claim 4 wherein said slider-driving means, said horizontally driving means and said hook-driving means cooperate also to transfer an article-carrying hanger selectively from a conveyor means for transporting said article-carrying hanger to said extractor to said hanger-supporting end of said hook or from said hanger-supporting end of said hook to a discharge chute means for removing said article-carrying hanger away from said extractor.

6. The extractor of claim 4 wherein said hook-driving means moves said hook between a raised position and a lowered position lower than said raised position.

7. An extractor for washed articles, comprising;

a hollow outer structure with open top;

a hollow inner structure inside said outer structure, said inner structure having open top and perforated side walls;

driving means for rotating said inner structure around a vertical axis;

a plurality of supporting means inside and on said side walls of said inner structure for supporting washed articles;

supply means for delivering washed articles thereon downward into said hollow inner structure and thereby automatically causing said washed articles to become supported by said supporting means; and discharge means for automatically removing said washed articles upwards from said supporting means and out of said inner structure;

wherein said washed articles are each hung from a hanger, said plurality of supporting means are each capable of allowing an article-carrying hanger to hang therefrom, said supply means is capable of delivering an article-carrying hanger downward into said hollow inner structure and causing said hanger to become supported by said supporting means, and said discharge means is capable of removing an article-carrying hanger upwards from said supporting means and out of said inner structure.

8. The extractor of claim 7 wherein said supply means and said discharge means each comprise a slider adapted to move vertically upward and downward and article delivering means attached to said slider for delivering an article-carrying hanger, said article delivering means comprising:

a slidable plate which is slidable horizontally with respect to said slider;

a hook which is rotatably supported by said slidable plate;

slider-driving means for moving said slider vertically upward and downward;

horizontally driving means for causing said slidable plate to slide horizontally with respect to said slider; and hook-driving means for causing said hook to swing with respect to said slidable plate.

9. The extractor of claim 8 wherein said hook has a hanger-supporting end for suspending an article-carrying hanger therefrom, and wherein said slider-driving means, said horizontally driving means and said hook-driving means cooperate to transfer an article-carrying hanger selectively from said hanger-supporting end of said hook to one of said plurality of supporting means or from one of said plurality of supporting means to said hanger-supporting end of said hook.

10. The extractor of claim 9 wherein said slider-driving means, said horizontally driving means and said hook-driving means cooperate also to transfer an article-carrying hanger selectively from a conveyor means for transporting said article-carrying hanger to said extractor to said hanger-supporting end of said hook or from said hanger-supporting end of said hook to a discharge chute means for removing said article-carrying hanger away from said extractor.

11. The extractor of claim 10 wherein said hook-driving means moves said hook between a raised position and a lowered position lower than said raised position.

* * * * *